United States Patent [19]

Nakamura, deceased

[11] 4,346,661

[45] Aug. 31, 1982

[54] FURNACE FOR TREATING INDUSTRIAL WASTES

[75] Inventor: Takeo Nakamura, deceased, late of Osaka, Japan, by Fuji Nakamura, heir

[73] Assignee: Osaka Gas Kabushiki Kaisha, Osaka, Japan

[21] Appl. No.: 132,058

[22] Filed: Mar. 20, 1980

[51] Int. Cl.[3] ..... F23G 3/00

[52] U.S. Cl. ..... 110/259; 110/235; 110/251; 266/200; 432/97

[58] Field of Search ..... 110/251, 235, 245, 346, 110/259; 432/13, 14, 97; 266/200

[56] References Cited

U.S. PATENT DOCUMENTS 2,754,779 7/1956 Toepel ..... 110/251
3,958,919 5/1976 Kjell-Berger ..... 432/13 X
4,027,603 7/1977 Lohner ..... 110/251
4,116,136 9/1978 Mallek et al. ..... 110/251
4,177,740 12/1979 Lamb et al. ..... 110/254 X

FOREIGN PATENT DOCUMENTS 52-28177 2/1977 Japan ..... 110/235

*Primary Examiner*—Edward G. Favors
*Attorney, Agent, or Firm*—Edwin E. Greigg

[57] ABSTRACT

A furnace for treating sewage sludge, ash from municipal incinerators or other industrial wastes by melting the waste with a high-temperature bed formed from a combustible carbonaceous material for the reuse of the resulting molten product, for example, as aggregate. A gas for combustion is supplied to the bed at an intermediate portion between its upper and lower portions while causing the resulting combustion gas to flow through the bed dividedly upward and downward.

7 Claims, 2 Drawing Figures

FURNACE FOR TREATING INDUSTRIAL WASTES

BACKGROUND OF THE INVENTION

The present invention relates to a furnace for treating sludges from sewage treatment processes, industrial wastes, or wastes which are crushed, dried, burned or otherwise semi-treated as desired, by melting the waste with a high-temperature furnace bed of combustible carbonaceous substance to draw off a molten product from the bottom of the bed so that the product can be used, for example, for construction purposes as an aggregate, or for reclamation without entailing the release of heavy metals.

Since low initial cost and reduced running cost are usually essential requirements for furnaces for treating industrial wastes, it is desired that such furnaces be directly heated with a combustible carbonaceous material, for example, with coke. To assure combustion for giving a high temperature needed for melting the waste, air or like gas must then be supplied to the combustible material at a high rate. What matters is therefore how to supply the gas for combustion.

With a simple system in which air or like gas is fed to a high-temperature furnace bed of combustible carbonaceous material from below to effect combustion to cause the resulting combustion gas to flow upward, dust of the waste and ash (hereinafter referred to simply as "dust") are exposed to, and scattered upward by, a large quantity of combustion gas flowing at a high speed, with the result that the dust will be released from the furnace as entrained in the combustion gas. The exhaust gas is therefore very likely to cause secondary pollution, or clog up, damage or overheat the exhaust duct due to the deposition of molten dust.

Conversely with another system in which the gas for combustion is fed to the high-temperature furnace bed from above to cause the resulting combustion gas to flow downward, the water contained in the waste will flow down along with the combustion gas, giving a reduced temperature to the lower portion of the bed. Additionally the carbon dioxide and water resulting from the combustion of the waste, or the water initially contained in the waste also flows downward with the combustion gas, undergoing reduction reaction with the carbon component of the combustible carbonaceous material in the lower portion of the furnace bed to absorb the ambient heat and eventually reducing the temperature of the lower portion of the bed. At a reduced temperature, the molten product will block up and will not be run off from the furnace smoothly.

Presumably secondary pollution and other objections due to the exhaust gas could be prevented with use of a secondary combustion chamber or combustion promoting device, or by returning the exhaust gas into the furnace, while an additional heater, if provided for the lower portion of the bed, would be useful for keeping this portion at the desired high temperature. Such means, however, would render the furnace construction complex and result in an increase in the initial cost as well as in the running cost due to damage to the structure, thus failing to fulfill the foregoing requirements.

SUMMARY OF THE INVENTION

The main object of this invention is to provide a furnace for treating industrial wastes which employs an economically advantageous direct heating system with use of combustible carbonaceous materials and which nevertheless is capable of effectively preventing scattering of dust and smoothly discharging the molten product without necessitating a complex construction.

To accomplish this object, the furnace of the present invention is adapted to supply air or like gas to a high-temperature bed of combustible carbonaceous material at an intermediate portion between its upper and lower portions to effect combustion while causing the resulting combustion gas to flow through the bed dividedly upward and downward.

When the gas supplied to the intermediate portion of the high-temperature bed for combustion is subsequently passed through the furnace dividedly upward and downward, upward scattering of dust can be minimized with the lower portion of the bed maintained at the desired temperature. Consequently the furnace, although relatively simple in construction, operates satisfactorily in its entirety, substantially without permitting the exhaust gas to cause secondary pollution or clog up the duct with a deposit of molten dust. Additionally the molten waste can be drawn off smoothly.

According to an embodiment of the invention, industrial wastes or semi-treated wastes are fed to the upper surface of the high-temperature bed laterally of the furnace so as to be melted by contact with the bed.

When the furnace is thus adapted to melt the waste with the high-temperature bed in contact therewith, dust can be prevented from scattering more effectively despite the presence of the combustion gas or even if gases are flowing through the interior of the furnace at a high speed to form the bed. This serves to eliminate the pollution and other problems attributable to exhaust emissions. The furnace is simple in construction because the furnace needs only to be so modified that wastes or semi-treated wastes can be fed to the furnace as directed to the bed. The furnace therefore achieves savings in initial, running and maintenance costs in its entirety, is operable with a greatly reduced likelihood of secondary pollution, accident and operational trouble and assures smooth discharge of the molten product.

Other objects and advantages of this invention will become apparent from the following description.

DESCRIPTION OF THE PREFERRED EMBODIMENT

Figure 1:
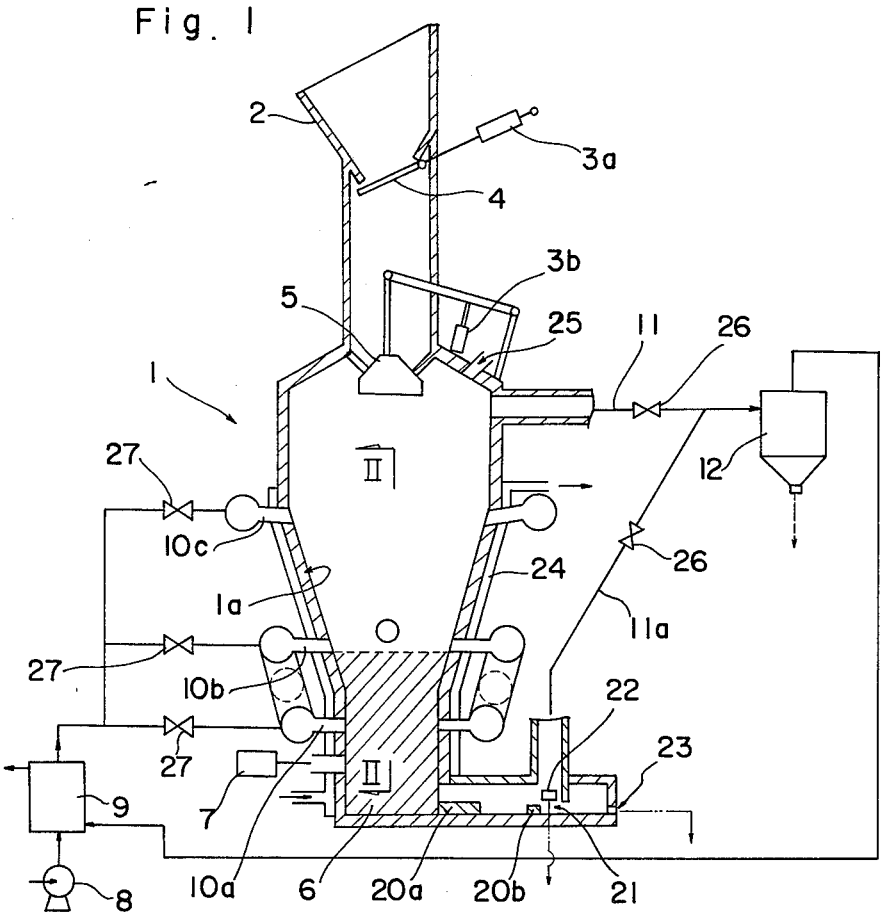
FIG. 1 is a view in vertical section schematically showing an embodiment of the invention for treating industrial wastes.
Figure 2:
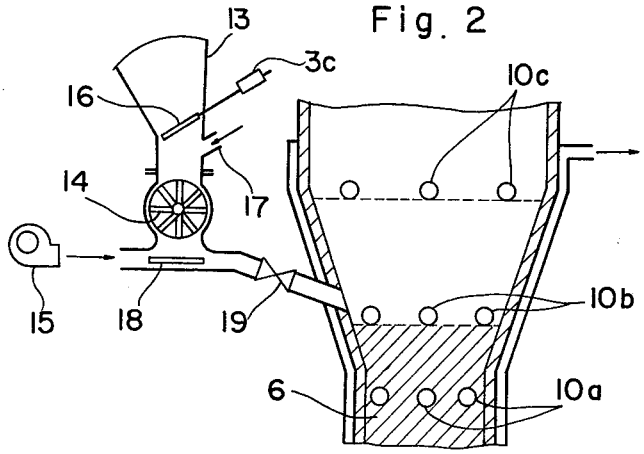
FIG. 2 is a view in section taken along the line II—II in FIG. 1.

An embodiment of the invention will be described below with reference to the accompanying drawings.

A vertical furnace 1 is provided at its top with a hopper 2 for feeding a suitable amount of coke to the furnace 1 when a gate 4 and a bell 5 are opened by hydraulic cylinders 3*a* and 3*b* respectively. A high-temperature bed 6 is formed from burning coke in the lower portion of the furnace in its interior. The bed 6 is ignited by a burner 7, which is put out after ignition. Preheated air, an example of gas for effecting combustion, is supplied from a blower 8 to the furnace 1 through a heat exchanger 9 to sustain the combustion of the bed 6. The preheated air is supplied via lower supply channels 10*a* to an intermediate portion of the bed 6 between its upper and lower portions, via intermediate supply channels 10*b* to the upper surface of the bed 6, and via upper supply channels 10*c* to the space in the upper portion of the furnace. The preheated air maintains the bed 6 at a high temperature sufficient to melt wastes and also effects after combustion in the furnace upper portion to completely burn the waste. The resulting combustion gas flows through an exhaust channel 11 into a dust separator 12, from which the gas is led to the heat exchanger 9. The quantities of preheated air fed through the supply channels 10*a*, 10*b*, 10*c* are approximately in the ratio of 3–10:1:1. Thus a major portion of the air is fed to the intermediate portion of the bed 6 by way of the lower supply channels 10*a*. The intermediate supply channels 10*b* and the upper supply channels 10*c* can be omitted when so desired. Immediately above the bed 6, the furnace 1 has a tapered inner peripheral wall 1*a* extending upwardly outward to reduce the speed of gas flowing upward from the bed and thereby inhibit scattering of dust due to the combustion gas.

Sludge from a sewage treatment process or some other industrial waste, which may be semi-treated to particles, grains or lumps by crushing, drying or burning when desired, is supplied from a hopper 13 through a rotary feeder 14 to the upper surface of the bed 6 by being forced thereagainst with pressurized air from a blower 15 so that the waste will be melted by contact with the high-temperature bed 6, with dust prevented from scattering despite the flow of combustion gas as well as of the air supplied for combustion. The waste feeding system is equipped with a shutter 16 operable by a hydraulic cyclinder 3*c* for adjusting the feed, safety opening 17, deposition preventing plate 18, flow regulating valve 19, etc. so as to feed the waste at a rate suitable for melting.

The molten waste is led through a discharge channel provided with barriers 20*a* and 20*b* to a gravity separator 21. When the molten waste separates into two layers, the low-gravity melt is run off from a first outlet 22, and the high-gravity melt from a second outlet 23. The gas in the separator 21 is led through an exhaust gas dust 11*a* to join the exhaust gas from the upper portion of the furnace 1. Consequently the air fed to the intermediate portion of the bed 6 through the lower supply channels 10*a* is divided into upward and downward flows within the bed 6 and drawn off from the furnace 1 partly through the exhaust channel 11, with the remainder discharged through the duct 11*a*. It has been found that the best result is available when the air is divided upward and downward in an approximately ratio of 2–10:1. When the downwardly flowing combustion gas is discharged from the furnace 1 through the discharge outlet for the molten waste in this way, or is discharged via an outlet close to the outlet, the molten waste is prevented from solidification effectively and can be run off smoothly.

FIG. 1 further shows a water-cooled jacket 24 for protecting the furnace, an air inlet 25 for after combustion, dampers 26 for regulating the flow of exhaust gas, and dampers 27 for adjusting the flow of preheated air.

Various combustible carbonaceous materials, such as waste graphite electrodes, are useful for forming the high-temperature bed 6. The furnace is usable for treating sewage sludges, waste tires, ashes from municipal incinerators, waste catalysts and other industrial wastes.

Industrial wastes or semi-treated wastes can be fed to the bed 6, for example, by a screw feeder, chute equipped with a slidable gate or some other modified device, in place of the illustrated means.

I claim:

1. A furnace for treating industrial wastes by melting said industrial waste or a semi-treated product thereof comprising a high-temperature bed including an upper portion and a lower portion formed from a combustible carbonaceous material which permits a molten product to be drawn off from said lower portion of said bed, means for supplying a gas for combustion to said high-temperature bed at an intermediate portion between said upper and lower portions of said high temperature bed and means for discharging said combustion gas at an upper and a lower portion of said furnace whereby said combustion gas is caused to flow through said high temperature bed dividedly upward and downward, said means for discharging said combustion gas at the lower portion of said furnace acting also as a discharge outlet for draining off molten products from said furnace.

2. A furnace as defined in claim 1 which comprises means for feeding said industrial waste or the semi-treated product thereof into said furnace just above the upper surface of said upper portion of said high-temperature bed laterally thereof so as to be melted by contact with said high-temperature bed.

3. A furnace as defined in claim 1 or 2 characterized in that immediately above said high-temperature bed, said furnace comprises a tapered inner peripheral wall extending upwardly and outward.

4. A furnace as claimed in claims 1 or 2 which includes means for supplying a combustion gas laterally immediately above said upper bed portion.

5. A furnace as claimed in claims 1 or 2 which includes means for supplying a combustion gas into said furnace in an area well above said upper bed portion.

6. A furnace as claimed in claims 1 or 2 which includes second and third means for supplying a combustion gas laterally into said furnace, said second means supplying said combustion gas immediately above said upper high temperature bed portion and said third means supplying said combustion gas above said second means for supplying combustion gas into said furnace.

7. A furnace as claimed in claim 1 or 2 which includes an air inlet for admitting air that aids in after combustion of the combustible products.

* * * * *